US008292423B2

(12) United States Patent
Watanabe

(10) Patent No.: US 8,292,423 B2
(45) Date of Patent: Oct. 23, 2012

(54) PLATEN AND INKJET RECORDING APPARATUS

(75) Inventor: Yusaku Watanabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 168 days.

(21) Appl. No.: 12/693,213

(22) Filed: Jan. 25, 2010

(65) Prior Publication Data

US 2010/0134557 A1 Jun. 3, 2010

Related U.S. Application Data

(62) Division of application No. 11/275,836, filed on Jan. 31, 2006, now Pat. No. 7,654,664.

(30) Foreign Application Priority Data

Jan. 31, 2005 (JP) ..... 2005-024427
Jan. 31, 2005 (JP) ..... 2005-024579

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 5,831,647 | A | 11/1998 | Kawakami et al. | |
| 6,457,803 | B1 | 10/2002 | Ohkoda | |
| 6,899,411 | B2 | 5/2005 | Niikura et al. | |
| 7,011,389 | B2 | 3/2006 | Edamura et al. | |
| 7,093,931 | B2 | 8/2006 | Ishii et al. | |
| 2002/0041303 | A1 | 4/2002 | Yoshinaga | |
| 2002/0089564 | A1 | 7/2002 | Ohashi | |
| 2003/0214549 | A1* | 11/2003 | Ogasawara | 347/35 |
| 2003/0227529 | A1 | 12/2003 | Hosono | |
| 2004/0189767 | A1 | 9/2004 | Kodama et al. | |
| 2005/0195258 | A1 | 9/2005 | Nukui | |
| 2005/0200652 | A1* | 9/2005 | Massey | 347/40 |

FOREIGN PATENT DOCUMENTS

| | | | |
|---|---|---|---|
| JP | H05-261940 | A | 10/1993 |
| JP | H06-198907 | A | 7/1994 |
| JP | H08-318629 | A | 12/1996 |
| JP | H09-076530 | A | 3/1997 |

(Continued)

OTHER PUBLICATIONS

Japan Patent Office, Notice of Reason(s) for Rejection in counterpart Patent Application No. JP 2005-024579, mailed Nov. 10, 2009.

(Continued)

*Primary Examiner* — Matthew Luu
*Assistant Examiner* — Kendrick Liu
(74) *Attorney, Agent, or Firm* — Baker Botts L.L.P.

(57) ABSTRACT

A platen for supporting a reverse surface of a recording medium under a recording head capable of performing image recording with ink droplets on the recording medium, which is conveyed along a specified direction in a main body of an inkjet recording apparatus. The platen comprises an ink receiving portion which receives ink and an ink guiding portion. The ink guiding portion guides the ink received by the ink receiving portion to an ink absorbing member. Specifically, the ink guiding portion guides the ink to an ink guide groove provided in an upper surface of a placement portion, on which the ink absorbing member is placed.

16 Claims, 13 Drawing Sheets

FOREIGN PATENT DOCUMENTS

| | | | | |
|---|---|---|---|---|
| JP | H10-291328 | A | | 11/1998 |
| JP | 2002-086821 | A | | 3/2002 |
| JP | 2002-127462 | A | | 5/2002 |
| JP | 2002-234188 | A | | 8/2002 |
| JP | 2002301832 | A | * | 10/2002 |
| JP | 2003-039753 | A | | 2/2003 |
| JP | 2003-103849 | A | | 4/2003 |
| JP | 2003-285487 | A | | 10/2003 |
| JP | 2003-312026 | A | | 11/2003 |
| JP | 2003-320688 | A | | 11/2003 |
| JP | 2004-009407 | A | | 1/2004 |
| JP | 2004-034412 | A | | 2/2004 |
| JP | 2004-090447 | A | | 3/2004 |
| JP | 2004-142147 | A | | 5/2004 |
| JP | 2004-155109 | A | | 6/2004 |

OTHER PUBLICATIONS

Japan Patent Office, Notice of Reason(s) for Rejection in counterpart Patent Application No. JP 2005-024427, mailed Nov. 10, 2009.

Japan Patent Office, Decision of Rejection in Japanese Patent Application No. 2005-024427 (counterpart to the above-captioned U.S. patent application) mailed Feb. 2, 2010.

Japan Patent Office, Decision of Rejection in Japanese Patent Application No. 2005-024579 (counterpart to the above-captioned U.S. patent application) mailed Feb. 2, 2010.

* cited by examiner

PLATEN AND INKJET RECORDING APPARATUS

CROSS-REFERENCE TO RELATED APPLICATIONS

This application is a divisional application of U.S. patent application Ser. No. 11/275,836, filed on Jan. 31, 2006, which claims the benefit of Japanese Patent Application No. 2005-24427 and Japanese Patent Application No. 2005-24579 both filed Jan. 31, 2005 in the Japanese Patent Office, the disclosures of which are incorporated herein by reference.

BACKGROUND

The present invention relates to a platen for use in an inkjet recording apparatus capable of performing a so-called marginless image recording, in which an image is printed on the entire area of a printing medium (for example, recording paper) without leaving a margin, and to an inkjet recording apparatus provided with the platen.

In a general inkjet recording apparatus, an ink ejection surface of a recording head mounted on a carriage, which is reciprocable in a main scanning direction, is provided so as to face a recording surface of a recording paper as a recording medium. A platen is provided to support the recording paper from under the recording paper such that a distance between the ink ejection surface and the recording surface of the recording paper is defined. Recording of an image is performed by ejecting ink from the ink ejection surface while the recording paper is supported by the platen.

There has been an inkjet recording apparatus, in which a so-called marginless image recording can be preformed by ejecting ink to an area larger than the recording surface of the recording paper and thereby recording an image over the entire surface of the recording paper without leaving a margin.

There is a known inkjet recording apparatus which comprises a platen including a slanting surface in a position facing a recordable area of a recording head, and an ink absorbing member arranged in the vicinity of a wall surface formed integrally with and in a lower portion of the slanting surface.

A plurality of ribs are formed on the slanting surface so as to extend in a recording paper conveying direction. The ribs are also arranged in predetermined intervals in a direction perpendicular to the recording paper conveying direction. Each rib includes an absent part, through which ink discarded during marginless image recording is discharged. The discarded ink then flows on the slanting surface and is absorbed by the ink absorbing member. It is advantageous to provide a groove in the slanting surface and the wall surface for accelerating the flow of discarded ink, the groove extending downward along the slanting direction or along the wall surface.

Also, there is a known waste tray for collecting ink discarded in an inkjet recording apparatus. The waste tray comprises a non-collecting area, an ink receiving area and a collecting area. A first ink absorbing member is provided in the ink receiving area, while a second ink absorbing member is provided in the collecting area. A plurality of V-shaped grooves as "ink guide passages" are formed in a bottom portion of the non-collecting area in predetermined intervals. Ink discarded into the non-collecting area flows in the V-shaped grooves, and thereby is rapidly discharged into the ink receiving area communicating with the non-collecting area.

As described above, it is common to provide grooves as "ink guide passages" in a path of ink (e.g., a horizontal surface, a slanting surface or a vertical surface) in order to rapidly and smoothly guiding discarded ink to the ink absorbing member.

However, the platen and the ink absorbing member in the known inkjet recording apparatus involves a disadvantage. Specifically, even when discarded ink rapidly flows through the grooves formed in the slanting surface and the wall surface, the ink flowing from the slanting surface to the wall surface will collectively flow into a portion of the ink absorbing member adjoining the slanting surface. Accordingly, the ink can be absorbed only through a limited portion of the ink absorbing member.

In the above described waste tray, in which grooves are provided only in the path of ink for guiding discarded ink to the ink absorbing member. Since the ink will collectively flow into a limited portion of the ink absorbing member in communication with the path of ink, the ink can be absorbed only through the limited portion of the ink absorbing member.

Accordingly, known technologies described above involve a problem that discarded ink cannot be absorbed rapidly by the ink absorbing member since the ink is absorbed only through a limited portion of the ink absorbing member adjoining an end portion of the slanting surface or the path of ink through which the ink flows.

The fact that ink is absorbed only through a limited portion of the ink absorbing member leads to a further problem. Specifically, since an ink absorption amount in the limited portion will easily reach saturation and the limited portion will easily lose absorbing ability due to aging deterioration caused by the ink absorbed by the limited portion, the ink absorbing member may become unable to absorb discarded ink, despite that the remaining portion of the ink absorbing member still has a sufficient ink absorbing ability.

There is another known inkjet recording apparatus which comprises a platen including a groove for discarding ink therein and an ink absorbing member, which is made of an elastic absorbing member and is contained in the groove, to perform marginless image recording. Discarded ink resulting from recording without leaving a margin on an edge portion of a sheet of recording paper is absorbed by the ink absorbing member contained in the groove provided in the platen. Accordingly, the discarded ink will not attach the sheet of the recording paper or the next sheet of the recording paper. Thus, soiling of the recording paper can be prevented.

However, the another known inkjet recording apparatus involves the following disadvantage. Specifically, when a user opens a cover of the inkjet recording apparatus, the ink absorbing member, which is contained in the groove provided in an upper surface of the platen, is exposed. Then, a hand of the user during an operation is likely to directly touch the ink absorbing member becoming dirty as time passes and thereby to get dirty.

Also, the ink absorbing member must be arranged so as not to project above an upper end of a rib formed on a surface of the platen to prevent an upper surface of the ink absorbing member from contacting a reverse surface (a surface which is not a recording surface) of the sheet of the recording paper conveyed. It is, therefore, necessary to strictly regulate the dimensions and the shape of the ink absorbing member and arrange the same on the platen. A material having a low shape stability, such as an elastic absorbing member used for the ink absorbing member, requires time and labor both in regulating the dimensions and the shape and in installing the ink absorbing member in the platen.

Furthermore, if the ink absorbing member becomes fuzzy, it is likely that fuzzy fibers soaked with ink will project from the groove in the platen and thereby will contact and soil the reverse surface of the sheet of the recording paper.

In addition, when a user opens the cover of the inkjet recording apparatus, the ink absorbing member, which is contained in the groove of the platen and becomes dirty as time passes, is seen by the user. The user who should insert his/her hand into the inkjet recording apparatus for some operation may feel uncomfortable to see noticeable dirty ink spots of the ink absorbing member. To avoid causing such an uncomfortable feeling, it is necessary to employ a material in black or dark gray for the ink absorbing member. This will result in a limited selection of a material for the ink absorbing member, and thus limiting the possibility of apparatus design.

SUMMARY

One aspect of the present invention may provide a platen capable of making discarded ink rapidly absorbed by an ink absorbing member and of sufficiently utilizing the absorbability of the ink absorbing member, and an inkjet recording apparatus provided with the platen the rein.

In the one aspect of the present invention, there is provided a platen for supporting a recording medium under a recording head capable of performing image recording with ink droplets on the recording medium, which is conveyed along a specified direction in a main body of an inkjet recording apparatus. The platen comprises an ink receiving portion which receives ink and an ink guiding portion.

The ink guiding portion guides the ink received by the ink receiving portion to an ink absorbing member. Specifically, the ink guiding portion guides the ink to an ink guide groove provided in an upper surface of a placement portion, on which the ink absorbing member is placed.

According to the above described configuration, the ink received by the ink receiving portion during image recording is guided to the ink guide groove provided in the upper surface of the placement portion, on which the ink absorbing member is placed. The ink guided to the ink guide groove flows along the ink guide groove toward under the ink absorbing member placed on the placement portion. Then, the ink is absorbed through the under surface of the ink absorbing member in a large area, in which the ink guide groove and the under surface of the ink absorbing member abut each other.

Since the ink can be absorbed evenly through a large area, in which the ink guide groove and the under surface of the ink absorbing member abut each other, the ink does not collectively flow into a limited portion of the ink absorbing member. It is, therefore, possible to make the ink rapidly absorbed by the ink absorbing member and to sufficiently utilize the absorbability of the ink absorbing member. This effect will be enhanced especially with a configuration in which multiple ink guide grooves are formed abreast of one another over an entire area under the ink absorbing member.

In another aspect of the present invention, there is provided a platen for supporting a reverse surface of a recording medium under a recording head capable of performing image recording with ink droplets on the recording medium, while the recording medium is conveyed along a specified direction in a main body of an inkjet recording apparatus. The platen comprises an ink absorbing member, a platen main body and a platen cover.

The ink absorbing member absorbs ink which is ejected from the recording head. The ink absorbing member is placed on the platen main body.

The platen cover is disposed on the platen main body so as to cover the ink absorbing member from above.

The platen main body includes an ink receiving portion that is disposed to face a recordable area of the recording head during the image recording and receives the ink and an ink guiding portion that guides the ink received by the ink receiving portion to the ink absorbing member.

The ink guiding portion may be, for example, a groove formed in an upper portion of the platen so as to extend from the ink receiving portion to the ink absorbing member. In this case, ink is guided by means of the inclination of the groove and a capillary phenomenon. Alternatively, the ink guiding portion may be a slanting surface formed such that ink is guided to the ink absorbing member disposed below the slanting surface.

According to the platen configured as above, the ink absorbing member for collecting ink discarded during image recording is covered with the platen cover. Accordingly, a user, who opens a cover of an inkjet recording apparatus and inserts a hand therein to perform some manual operation, such as replacing an ink cartridge or removing jammed paper, is unlikely to touch the ink absorbing member soiled with the ink. The user, therefore, can keep the hand clean.

Also, it is unnecessary to use a material, in which absorbed ink is relatively unnoticeable, for the ink absorbing member since the ink absorbing member is not directly seen by the user. Accordingly, a material having a high absorbability can be employed regardless of the color of the material, resulting in an improved performance of the ink absorbing member.

Furthermore, since the upper surface of the ink absorbing member is covered with the platen cover, a reverse surface of a recording medium will not be soiled by contacting the ink absorbing member.

In addition, since the height of the ink absorbing member is limited by the platen cover, the reverse surface of the recording medium will not contact the ink absorbing member regardless of the dimensions and the shape of the ink absorbing member. Accordingly, it in unnecessary to strictly regulate the dimensions and the shape of the ink absorbing member or waste time for installation of the ink absorbing member.

Furthermore, the ink absorbing member placed on the platen does not require a separate case for containing the ink absorbing member. Accordingly, reduction of the number of parts and downsizing of an image recording apparatus as a whole can be achieved.

BRIEF DESCRIPTION OF THE DRAWINGS

Preferred embodiments of the present invention will be described hereinafter with reference to the drawings, in which.

DETAILED DESCRIPTION OF THE PREFERRED EMBODIMENTS

[Overall Structure of Inkjet Recording Apparatus 1]

An inkjet recording apparatus 1 is a so-called multifunction device (MFD: Multi Function Device) including a printer function, a copier function, a scanner function, a facsimile function and others. A sheet P of paper, plastic film or the like is used as a recording medium.

Figure 1:
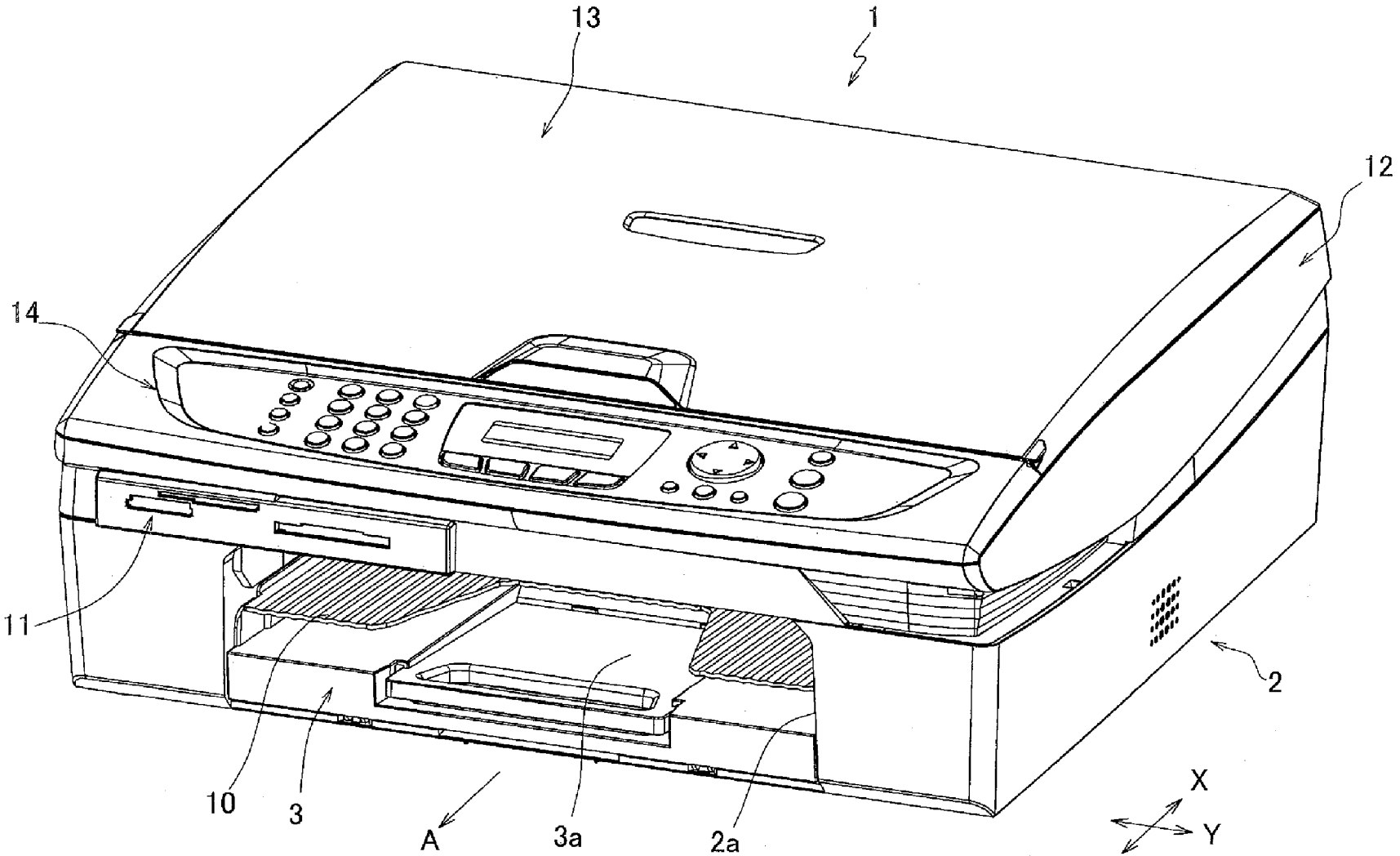
FIG. 1 is a perspective view showing an inkjet recording apparatus according to an embodiment of the present invention.

As shown in FIG. 1, the inkjet recording apparatus 1 comprises a housing 2 of synthetic resin and a sheet feed cassette 3, which can be inserted into the housing 2 through an opening 2*a* formed in a front and lower portion of the housing 2. A sheet discharge portion 10 for discharging the sheet P after recording in the direction of an arrow A is provided above the sheet feed cassette 3. A sheet discharge port in communication with the sheet discharge portion 10 is provided in an upper portion of the opening 2*a* in the front portion of the housing 2.

The sheet feed cassette 3 is configured so as to contain a plurality of sheets P cut into, for example, A4 size, letter size, legal size, postcard size, etc. Sheets P in each size is placed such that a longitudinal side of each sheet is parallel with a sheet conveying direction (a sub scanning direction or an X-axis direction). An auxiliary support member 3*a* for supporting a rear end portion of a relatively long sheet P like a sheet in legal size, or the like is attached to a front end of the sheet feed cassette 3 such that the auxiliary support member 3*a* is capable of extending in the direction of X. In the case of using sheets P in A4 size or the like capable of being housed within the sheet feed cassette 3, the auxiliary support member 3*a* can be retracted from the front end of the sheet feed cassette 3 so as not to hinder sheet feeding.

An image scanner 12, which is used in scanning documents to achieve the copier function or the facsimile function, is disposed in an upper portion of the housing 2. The image scanner 12 is configured so as to be rotatable upwardly and downwardly in opening and closing directions with respect to one side end of the housing 2 via a not-shown axis portion. Also, a document cover 13 to cover all over the top surface of the image scanner 12 is attached so as to be rotatable upwardly/downwardly around not-shown axis provided at a rear end of the image scanner 12.

To perform image scanning, the document cover 13 is opened upwardly, and a document is placed on a placement glass plate. Then, a contact image sensor (CIS: Contact Image Sensor) for document scanning, provided so as to be reciprocable along a Y-axis direction (i.e., a main scanning direction) under the placement glass plate, scans a document surface thereby to read an image on the document surface.

An operation panel 14, including various operation buttons and a liquid crystal display portion, is disposed in a front portion of the document cover 13 over the top surface of the image scanner 12. An external memory insertion portion 11 for inserting an external memory therethrough is provided in a front surface of the housing 2 and below the operation panel 14. The external memory here means, for example, a Compact Flash®, a Smart Media®, a Memory Stick®, an SD Card®, an xD® or the like.

Figure 2:
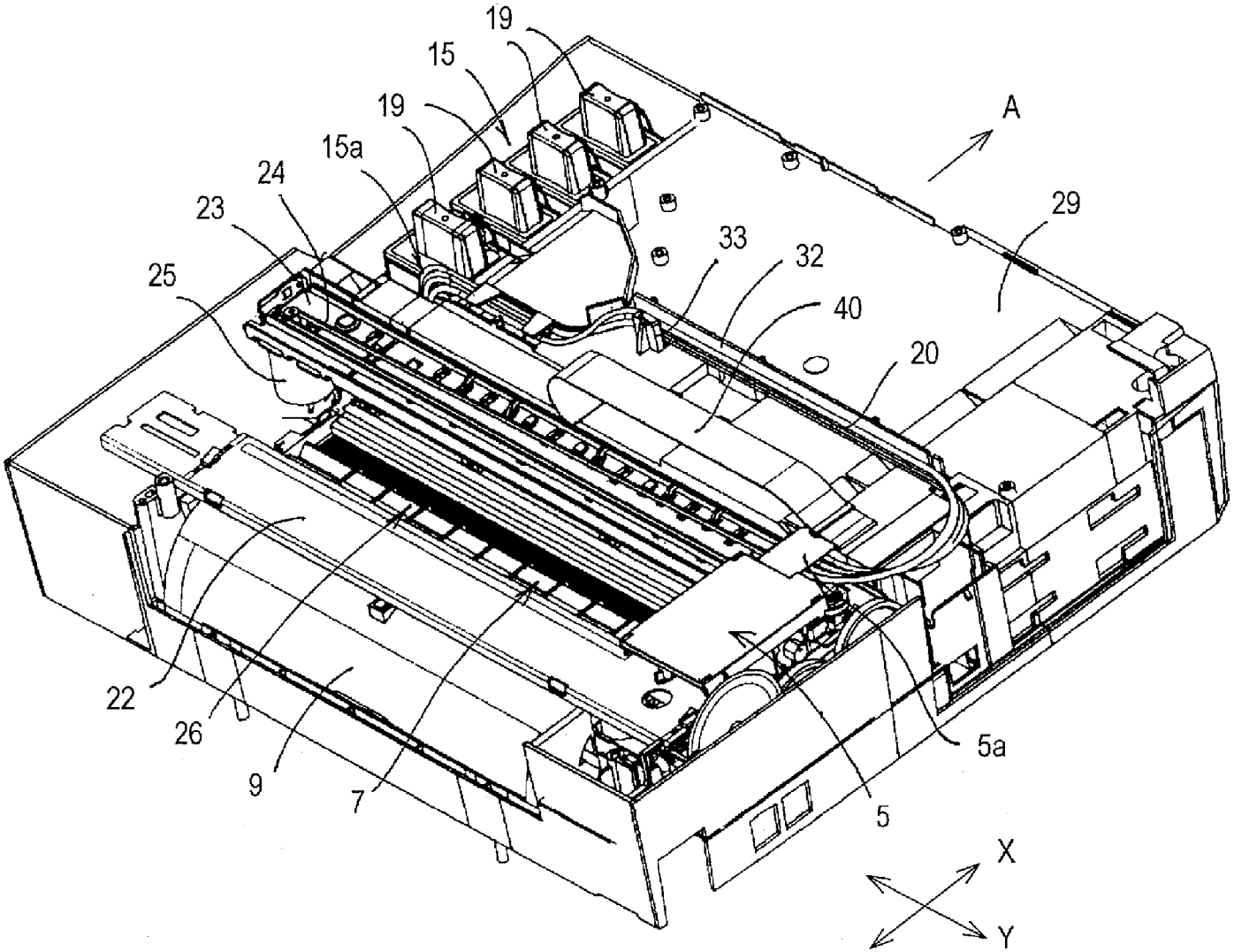
FIG. 2 is a perspective view showing a structure of a recording unit and a vicinity thereof inside the inkjet recording apparatus according to the embodiment of the present invention.

As shown in FIG. 2, a recording unit 7 including a carriage 5 and other mechanisms is provided inside the housing 2. The carriage 5 is reciprocable along the Y-axis direction (the main scanning direction), and a recording head 4 of an inkjet type (see FIGS. 4 and 5) for achieving the printer function is mounted on the carriage 5. A further detailed explanation of the recording unit 7 will be provided later.

An ink reservoir portion 13 is provided in a front portion inside the housing 2 so as to be open upward. The ink reservoir portion 15 houses ink cartridges 19 containing four colors (black, cyan, magenta and yellow) of ink, respectively, for performing full-color recording. The ink cartridges 19 are aligned in a line along the X-axis direction. The ink cartridges 19 are configured to be attached and detached from above the ink reservoir portion 15. To replenish ink of each color, the corresponding ink cartridge 19 is replaced with a new one. When the image scanner 12 is opened upward, replacement of the ink cartridge 19 may be performed by inserting a hand into the opened housing 2.

The inks contained in the ink cartridges 19 are supplied to the recording head 4 through four ink supply tubes 20 connecting the ink cartridges 19 and the recording head 4. In the case of using more ink colors than four (e.g., six colors or eight colors), the ink reservoir 15 may be configured to house a number of ink cartridges corresponding to the number of ink colors, and the number of the ink supply tubes 20 may be increased corresponding to the number of ink cartridges.

Respective one ends of the ink supply tubes 20 are connected to a connecting portion 5*a* of a base portion of the carriage 5. The other ends of the ink supply tubes 20 are bundled at one end portion 15*a* of the ink reservoir 15. The ink supply tubes 20 extend along the Y-axis direction on an upper surface of a lower cover 29. The ink supply tubes 20 are supported by the upper surface of the lower cover 29, a vertical partition plate 32 and a fixing member 33 provided on the lower cover 29 such that the ink supply tubes 20 can follow the reciprocating movement of the carriage 5.

A belt-like flexible flat cable 36 connected to the carriage 5 via the connecting portion 5 is disposed such that the flexible flat cable 36 can follow the reciprocating movement of the carriage 5. The flexible flat cable 36 is used to transmit a command signal from a control unit (not shown) to selectively eject ink droplets from nozzles of the recording head 4 mounted on the carriage 5.

Figure 3:
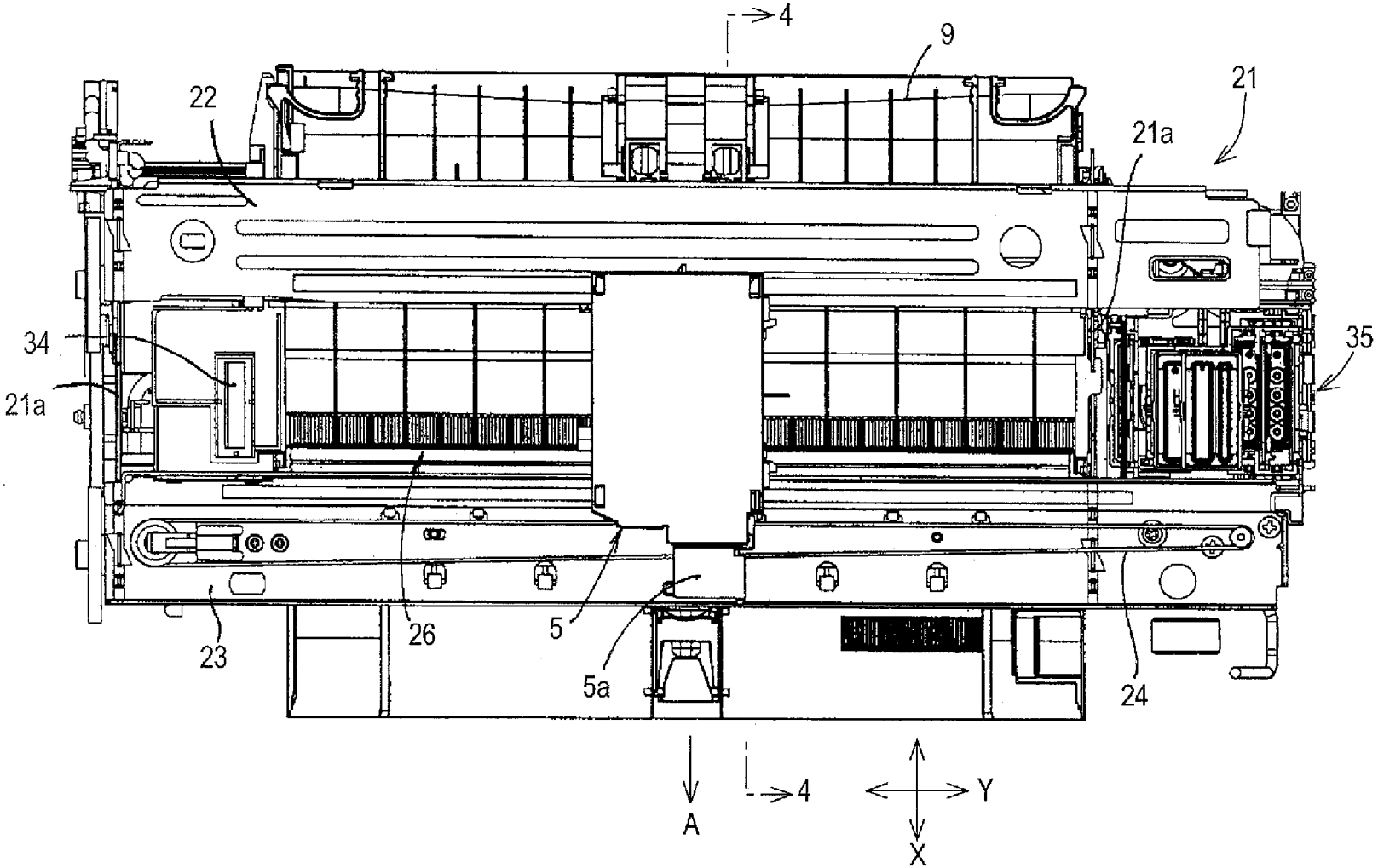
FIG. 3 is a plan view of the recording unit.

As shown in FIG. 3, the recording unit 7 includes plate-like guide members 22 and 23, the carriage 5, the recording head 4, a timing belt 24, a carriage motor 25, a platen 26, an encoder strip and other mechanism.

The guide members 22 and 23 are supported by a pair of left and right side panels 21*a* constituting a main frame 21 made of metal or the like, and extend horizontally along the Y-axis direction (the main scanning direction).

The carriage 5 is mounted in a bridging manner between the guide members 22 and 23 so as to be reciprocable along the main scanning direction. The recording head 4 of an inkjet-type is mounted on the carriage 5 (see FIGS. 4 and 5). The timing belt 24 is designed to transmit a drive power for reciprocating the carriage 5. The carriage motor 25 (see FIG. 2) is designed to drive the carriage 5 through the timing belt 24. The platen 26 is a substantially flat plate-like member that supports the sheet P to be conveyed from under the recording head 4. The encoder strip is disposed to extend along the Y-axis direction (the main scanning direction) in order to detect a position of the carriage 5 along the Y-axis direction (the main scanning direction).

The carriage 5 is controlled by the control unit (not shown) including a CPU to reciprocate along the Y-axis direction (the main scanning direction), thereby to scan the recording head 4. The recording head 4 ejects ink during the scanning to record an image on the sheet P stopped and located under the recording head. In this state, the sheet P is supported by the platen 26 constituting a conveying path of the sheet P. In other words, the recording head 4 is located right above the platen 26, and image recording on the sheet P by the recording head 4 is performed above the platen 26.

A waste ink receiver 34, which receives ink ejected during flushing operation performed by the recording head 4, is provided at a position outside a conveying area of the sheet P located on a left end side of the platen 26. A maintenance unit 35 supported by the guide members 22 and 23 is mounted at a waiting position of the carriage 5 on a right end side of the platen 26.

The recording head 4 periodically performs an ink ejection (flushing) during recording operation above the waste ink receiver 34 in order to prevent clogging of the nozzles, and the waste ink receiver 34 receives the ejected waste ink.

The maintenance unit 35 performs recovery processing, such as cleaning a nozzle surface of the recording head 4, selectively vacuuming each color of ink, and removing air bubbles from a not-shown buffer tank provided on the recording head 4.

In the nozzle surface (under surface) of the recording head 4, rows of nozzles are formed in appropriate intervals in the Y-axis direction. Each row of nozzles for each ink color includes a plurality of nozzles arranged along the X-axis direction. In the present embodiment, there are four rows of nozzles corresponding to the four ink colors, respectively, and the interval between the neighboring nozzles in each row is 75 dpi in the present embodiment.

Figure 4:
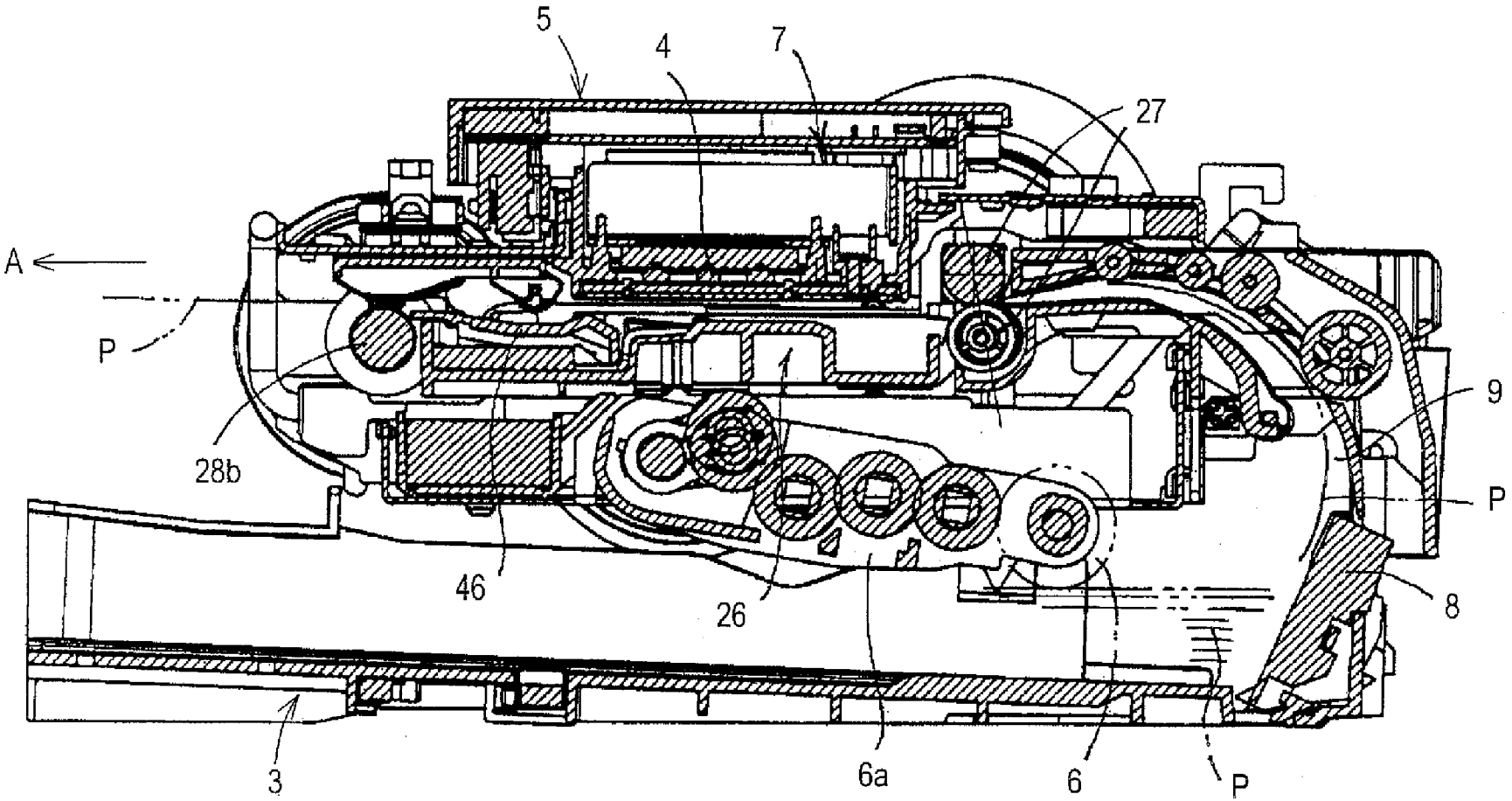
FIG. 4 is a cross-sectional view of the recording unit taken along line 4-4 in FIG. 3.

As shown in FIG. 4, a bank portion 8 including a slant separation plate for separating sheets is disposed on a rear side of the sheet feed cassette 3. An arm portion 6*a* is provided above the sheet feed cassette 3. A sheet feed roller 6 for feeding sheets is provided at a lower end portion of the arm portion 6*a*. The arm portion 6*a* is fixed so as to be pivotable in upper and lower directions around an upper end portion of the arm portion 6*a*.

In the above described configuration, when the control unit (not shown) receives a command to record an image, the sheet feed roller 6 is driven by the operation of a not-shown drive motor. Then, a plurality of sheets P including an uppermost sheet among the sheets P stacked in the sheet feed cassette 3 are fed toward the rear of the sheet feed cassette 3 (to the right direction in FIG. 4). The plurality of sheets P fed by the sheet feed roller 6 are separated to each sheet by a slant surface of the bank portion 8 separating sheets. The separated sheet P passes through a U-turn path 9 in an upward and lateral direction, and is fed to the recording unit 7 disposed above the sheet feed cassette 3.

Figure 5:
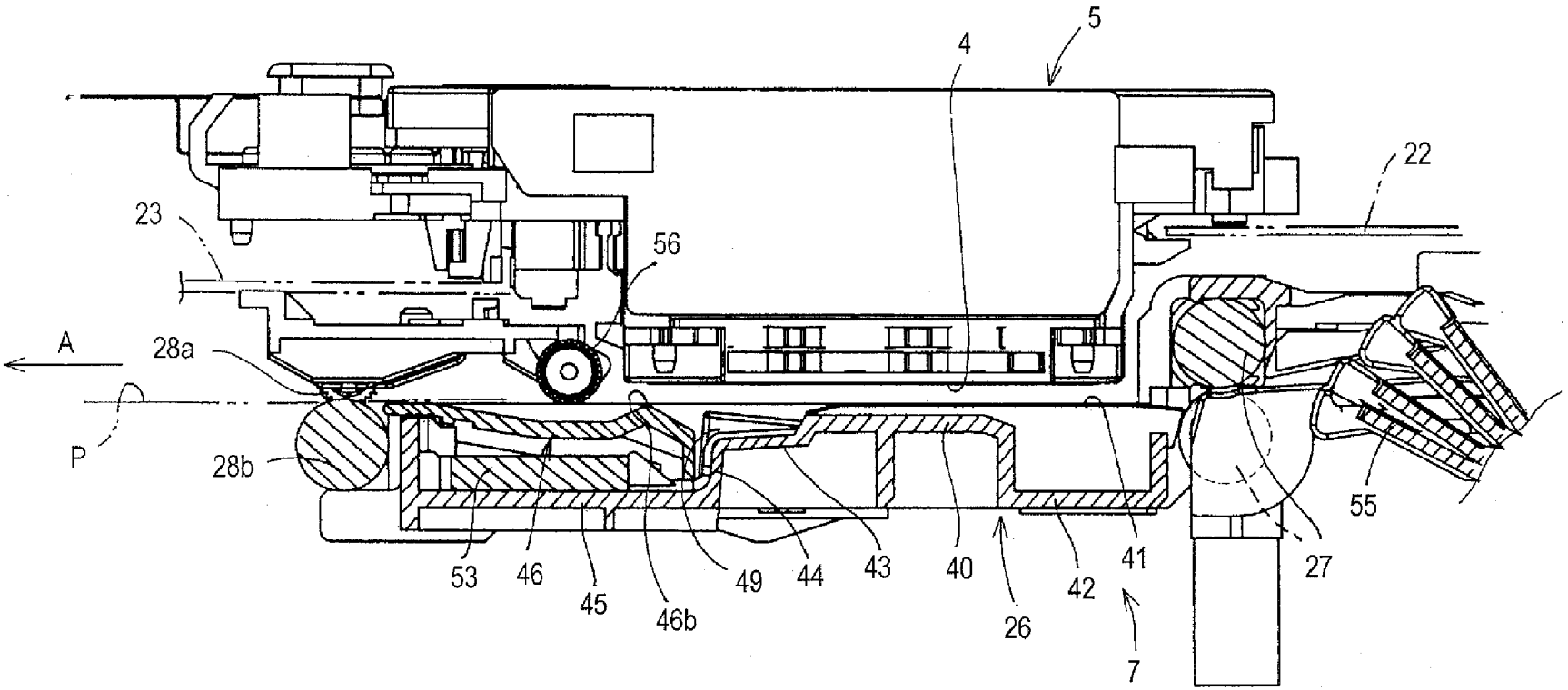
FIG. 5 is a partially enlarged cross-sectional view of the recording unit.

As shown in FIG. 5, the recording unit 7 includes a pair of regist rollers 27 disposed upstream from the platen 26 in the sheet conveying direction. A lever 55 for detecting a front edge of the sheet P is provided upstream from the pair of regist rollers 27.

While the sheet separated by the bank portion 8 is fed through the U-turn path 9 to the regist rollers 27, the front edge of the sheet P push back the lever 55. Then, a not-shown sensor detects the front edge of the sheet P, and transmits a front edge detection signal to the control unit. The control unit is configured to transmit an ink ejection command for ejecting ink from the nozzles of the recording head 4 when a predetermined time has elapsed since the control unit detects the front edge of the sheet P by receiving the front edge detection signal.

The sheet P conveyed to the regist rollers 27 is further conveyed to a position under the recording head 4, while being supported by the platen 26 from below. When ink is ejected from the recording head 4 in accordance with the ink ejection command from the control unit, recording is performed on the sheet P. Spur rollers 28*a* and 56 to contact an upper surface of the sheet P are disposed downstream from the platen 26 in the sheet conveying direction (the direction of an arrow A). A sheet discharge roller 28*b* to contact a under surface of the sheet P is also disposed downstream from the platen 26. The sheet P after recording is conveyed by the spur rollers 28*a* and 56, and the sheet discharge roller 28*b* to the sheet discharge portion 10.

The inkjet recording apparatus 1 of the present embodiment is configured to selectively perform a marginless image recording mode and a margin image recording mode in accordance with a selection command by a user. In the marginless image recording mode, image recording can be performed from the front edge to the rear edge of the sheet P to be conveyed in the direction of the arrow A in each figure without leaving a margin. Marginless image recording is achieved by ejecting ink over an area larger than a recording surface of the sheet P. Ink which is not attached to the recording surface of the sheet P is discarded (or collected for disposal) as extra ink.

Configuration of the Platen 26

First Embodiment

A configuration of the platen 26 according to a first embodiment will be described hereinafter.

Figure 7:
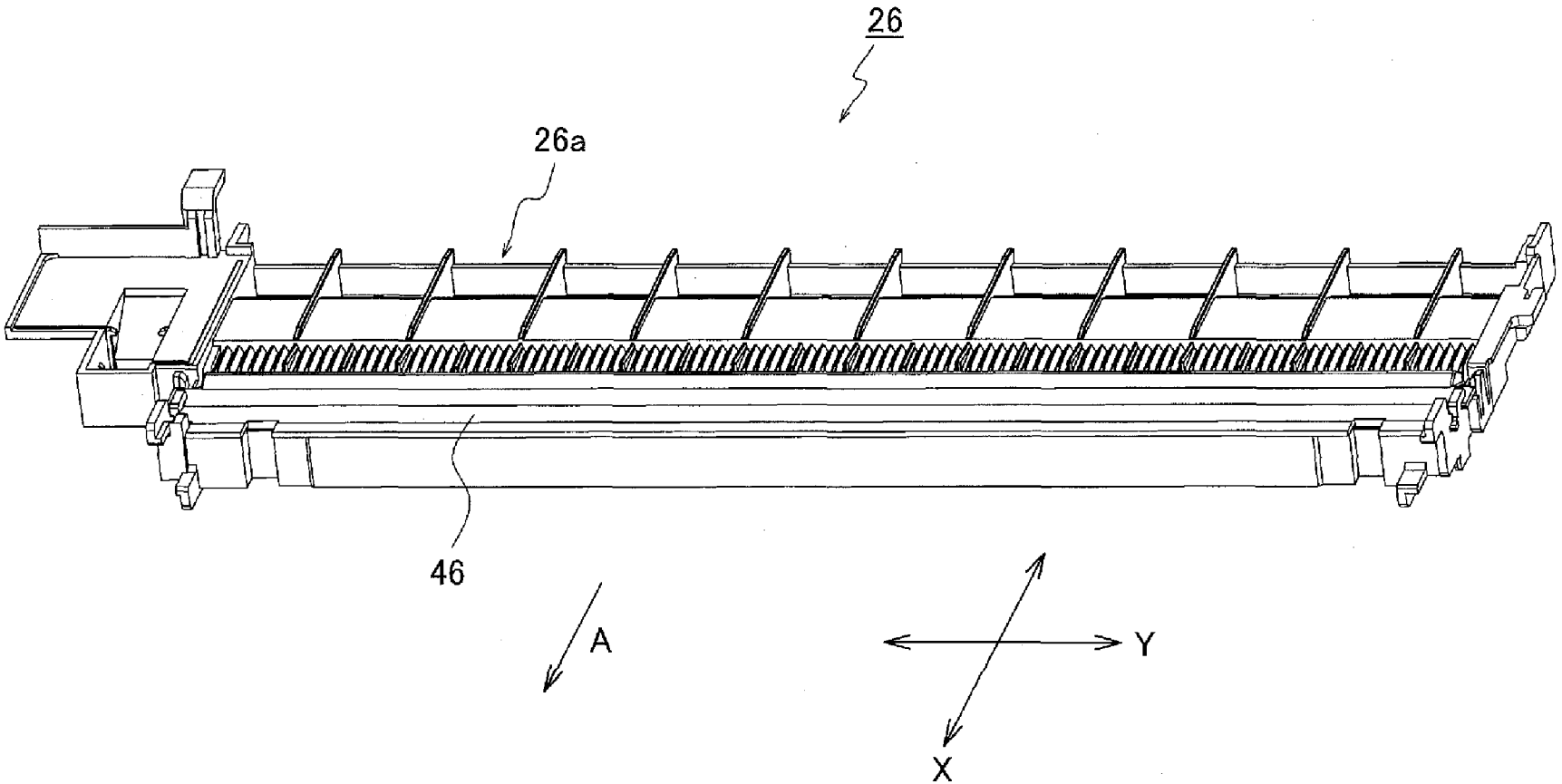
FIG. 7 is a perspective view of the platen according to a first embodiment of the present invention.
Figure 9A:
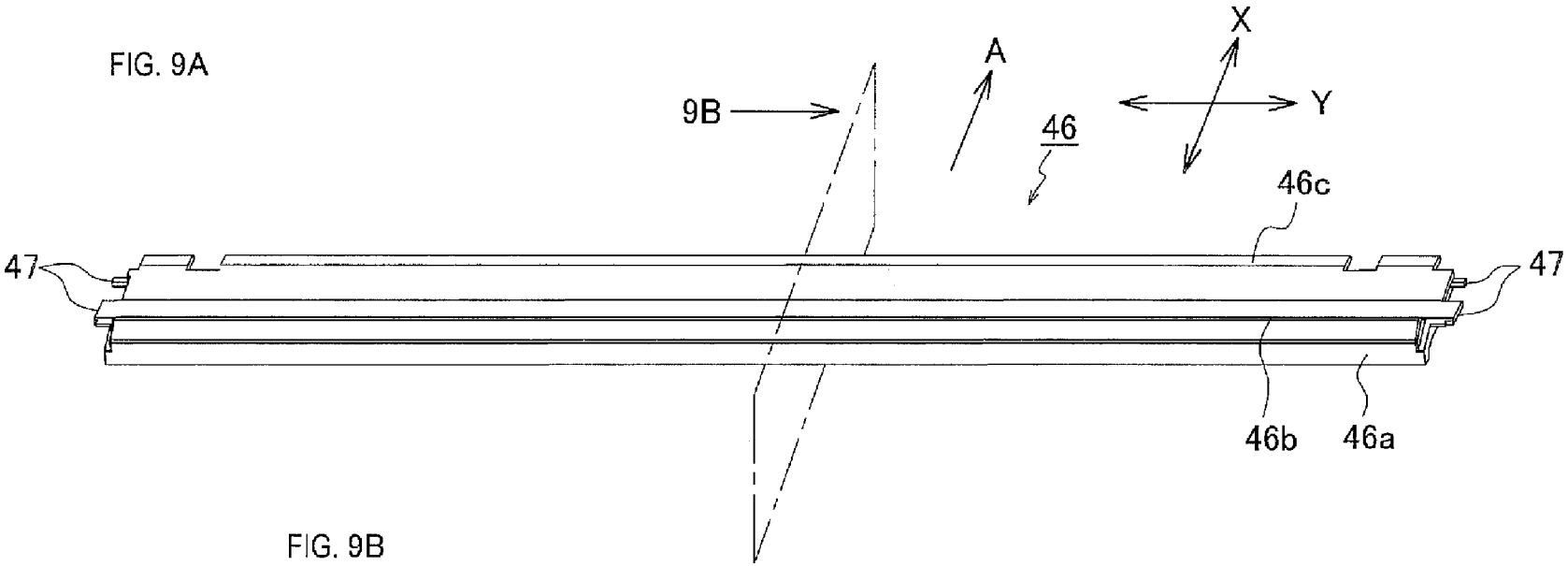
FIGS. 9A and 9B are a perspective view and a cross-sectional view taken along a plane in the direction of an arrow 9B, respectively, of a platen cover.
Figure 9B:
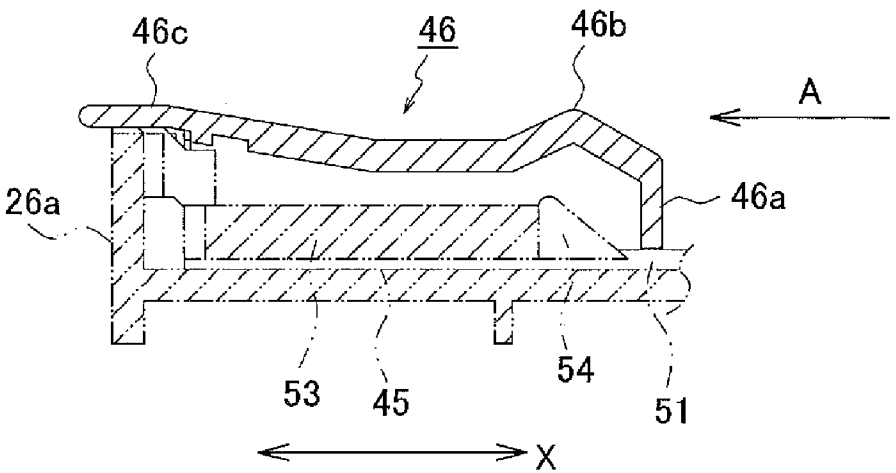

As shown in FIG. 7, the platen 26 includes a platen main body 26*a*, a platen cover 46 and an ink absorbing member 53 (see FIG. 9B). The platen main body 26*a* is a synthetic resin molding having a box shape with a substantially rectangular plan view. The platen cover 46, which is a synthetic resin molding having a plate shape with a substantially rectangular plan view, is fixed so as to cover a downstream side of the platen main body 26*a* in the sheet conveying direction (the direction of an arrow A), along the Y-axis direction. The ink absorbing member 53 is placed on the upper surface of the platen main body 26*a* and also within an inner space over the platen main body 26*a*. The inner space here is formed between the upper surface of the platen main body 26*a* and the platen cover 46 covering the upper surface of the platen main body 26*a*.

Figure 8A:
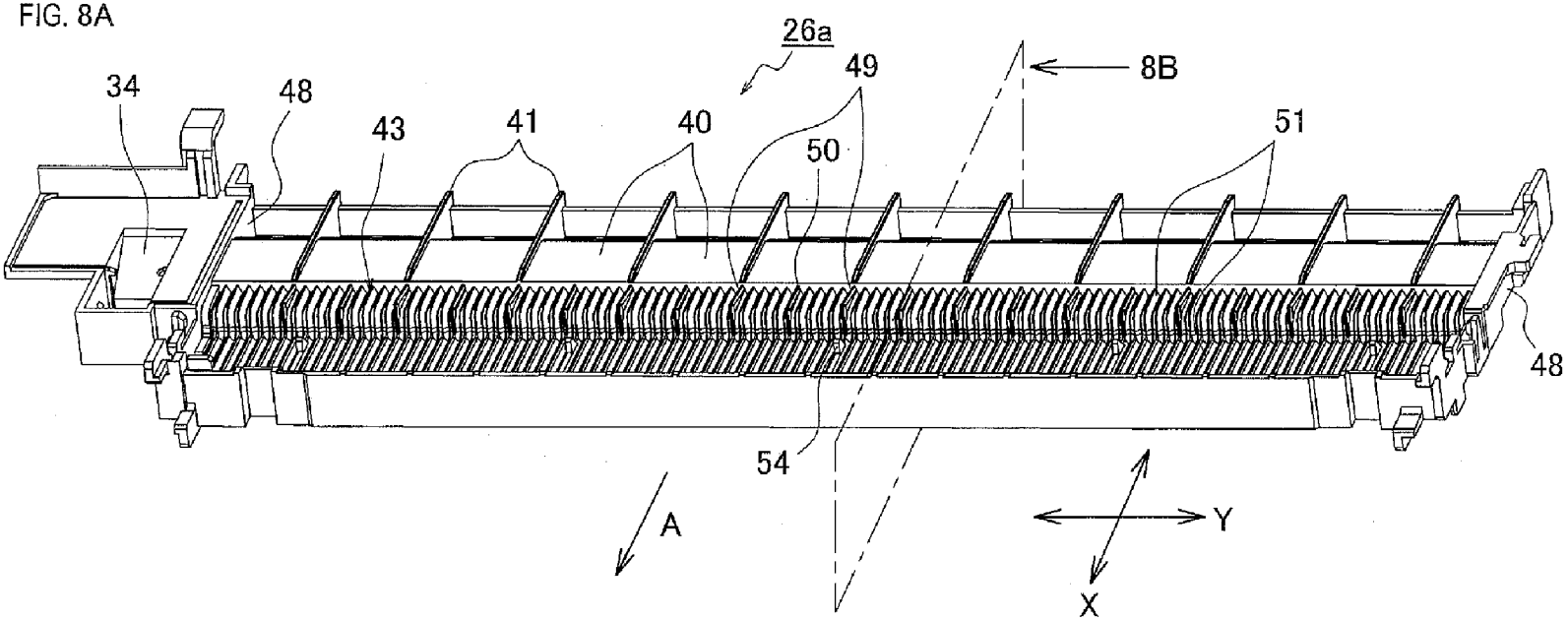
FIGS. 8A and 8B are a perspective view and a cross-sectional view taken along a plane in the direction of an arrow 8B, respectively, of a platen main body.
Figure 8B:
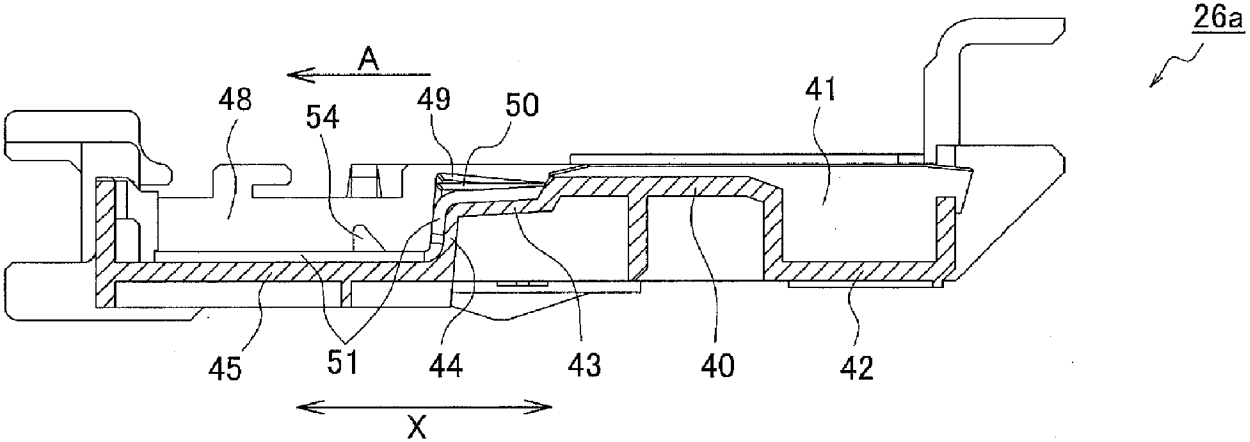

FIGS. 8A and 8B show the platen main body 26*a* in a state where the platen cover 46 and the ink absorbing member 53 are removed from the platen 26.

The platen main body 26*a* includes a substantially flat deck portion 40 extending in the Y-axis direction and disposed on an upstream side in the sheet conveying direction (the direction of an arrow A) so as to face a reverse surface of the sheet P. A U-shaped plate portion 42 having an upwardly opened U-shaped cross section is integrally connected to the deck portion 40 on an upstream side in the sheet conveying direction.

Figure 6:
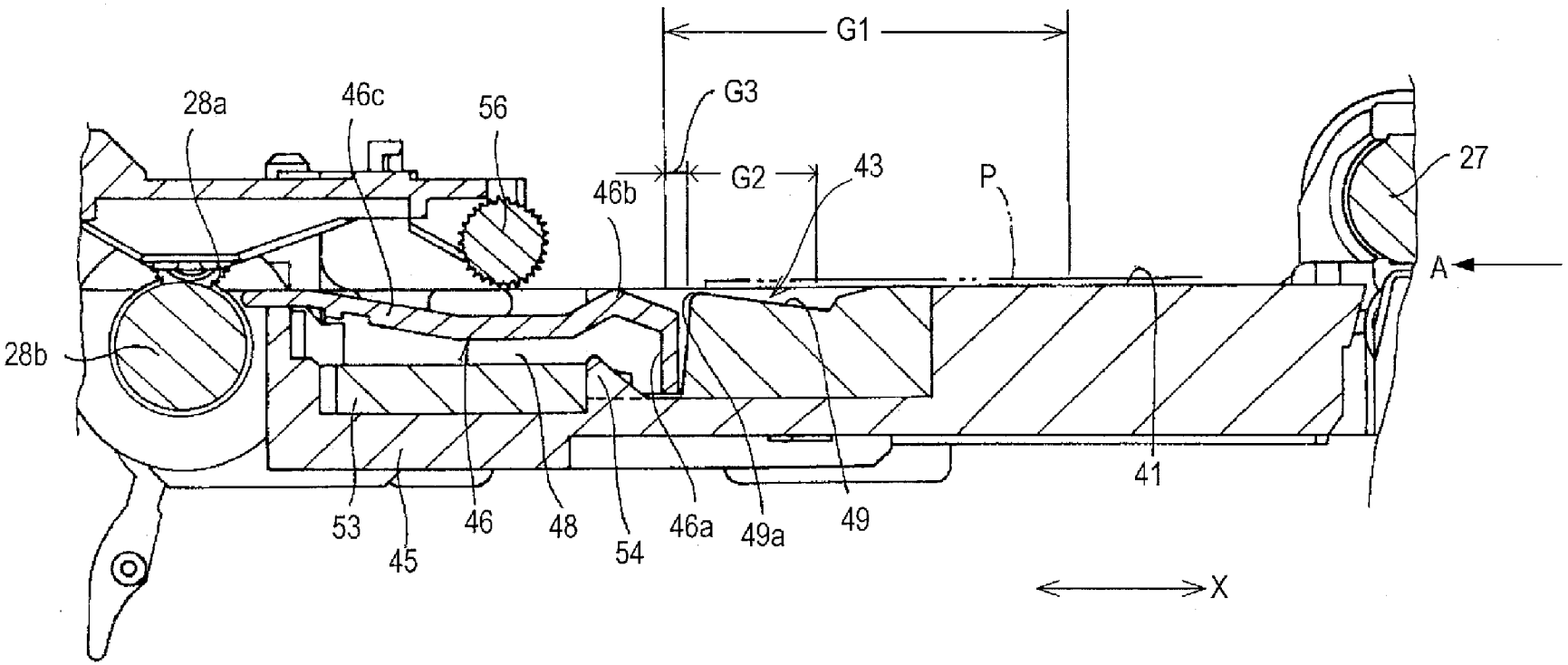
FIG. 6 is an enlarged cross-sectional view showing a platen and surrounding mechanisms in the recording unit.

An ink receiving portion 43 is integrally joined to an end of the deck portion 40 on a downstream side in the sheet conveying direction such that the ink receiving portion 43 is located at a lower position than the deck portion 40. The ink receiving portion 43 is provided for receiving extra ink ejected from the recording head 4 during marginless image recording. The ink receiving portion 43 has a width corresponding to a width in the X-axis direction of a marginless image recording area G2 (an ink ejection area during marginless image recording by the recording head 4, as shown in FIG. 6), and is downwardly inclined toward the downstream side in the sheet conveying direction.

A U-shaped plate-like placement portion 45 is provided on a downstream side of the ink receiving portion 43 in the sheet conveying direction and at a lower position than the ink receiving portion 43. In the placement portion 45, the ink absorbing member 53 is placed for absorbing extra ink ejected during marginless image recording. The ink receiving portion 43 and the placement portion 45 are integrally connected through a wall portion 44, which integrally extends downward from a downstream end of the ink receiving portion 43 in the sheet conveying direction.

Side frames 48 are provided integrally with the respective both ends, in the Y-axis direction (the main scanning direction), of the deck portion 40, the U-shaped plate portion 42, the ink receiving portion 43, the wall portion 44 and the placement portion 45. The above-mentioned waste ink receiver 34 is formed integrally with and on a lateral side of a left side frame 48.

A plurality of upstream side ribs 41 extending along the X-axis direction are provided in appropriate intervals along the Y-axis direction on the deck portion 40 and the U-shaped plate portion 42. The upstream side ribs 41, which are designed to support the sheet P conveyed on the platen 26 from below, extends from an upstream end of the U-shaped plate portion 42 in the sheet conveying direction to a joining portion between the deck portion 40 and the ink receiving portion 43 (i.e., a downstream end of the deck portion 40).

First ribs 49 and second ribs 50 of different types, which are designed to respectively support a front end portion and a rear end portion of the sheet P, are provided so as to extend along the sheet conveying direction (the X-axis direction).

The first ribs 49 are formed on the upper surface of the ink receiving portion 43 so as to project along an extended line in the sheet conveying direction from the respective upstream side ribs 41 and be upwardly inclined toward the downstream in the sheet conveying direction. The first ribs 49 extend from a joining portion between the deck portion 40 and the ink receiving portion 43 (i.e., an upstream end of the ink receiving portion 43 in the sheet conveying direction), form a highest portion at a downward end of the ink receiving portion 43 in the sheet conveying direction, and then extend downward along the wall portion 44 to a lower end of the wall portion 44.

Each of the second ribs 50 is provided to be located in the middle of two of the first ribs 49 abreast of one another along the Y-axis direction. The second rib 50 projects from the ink receiving portion 43 such that an upper end surface of the second rib 50 is horizontal over the ink receiving portion 43. The upper end surface of the second rib 50 is located at a lower position than the first rib 49.

In the same manner as the first ribs 49, the second ribs 50 extend from a joining portion between the deck portion 40 and the ink receiving portion 43 (i.e., an upstream end of the ink receiving portion 43 in the sheet conveying direction), form a higher portion at a downward end of the ink receiving portion 43 in the sheet conveying direction, and then extend downward along the wall portion 44 to a lower end of the wall portion 44.

A multiplicity of V-shaped grooves 51 are formed abreast of one another along the Y-axis direction (the main scanning direction) over an entire area of upper surfaces of the ink receiving portion 43 and the placement portion 45 and of the wall portion 44. Each of the V-shaped grooves 51 has a blunt V-shaped cross section, i.e., has a slightly round bottom, and is upwardly open. The V-shaped grooves 51 serve as ink flow paths that cause the extra ink ejected during marginless image recording and received by the ink receiving portion 43 to flow to the placement portion 45 to be absorbed by the ink absorbing member 53. The V-shaped grooves 51 extend from a joining portion between the deck portion 40 and the ink receiving portion 43 (i.e., an upstream end of the ink receiving portion 43 in the sheet conveying direction) to a vicinity of a downward end of the placement portion 45 in the sheet conveying direction through the wall portion 44.

Flat plate-like locating projections 54 to locatingly support the ink absorbing member 53 are formed to project from the upper surface of the placement portion 45 on an upstream side in the sheet conveying direction. The locating projections 54 are provided in appropriate intervals along the Y-axis direction.

The ink absorbing member 53 is placed substantially all over an area downstream from the locating projections 54 on the placement portion 45, and is supported by the locating projections 54 and a wall surface of the downward end of the placement portion 45 to avoid displacement. A detailed explanation about arrangement of the ink absorbing member 53 will be presented later.

The platen cover 46 will now be described with reference to FIGS. 9A and 9B. In FIG. 9B, cross sections of the platen main body 26*a* and the ink absorbing member 53 in a state where the platen cover 46 is attached to the platen main body 26 are indicated by two-dotted chain lines for explanation purposes.

The platen cover 46 is a synthetic resin molding having a substantially flat-plate like configuration with a generally rectangular plan view. The platen cover 46 is fixed so as to cover an upper side of the ink absorbing member 53 placed on the placement portion of the platen main body 26*a*. As shown in FIGS. 9A and 9B, the platen cover 46 has a side wall portion 46*a*, a protruding support portion 46*b*, a planar supporting portion 46*c* and projections 47.

The side wall portion 46*a* is formed in an upstream end of the platen cover 46 in the sheet conveying direction (the direction of the arrow A) so as to be substantially vertical.

The protruding support portion 46*b* includes an upwardly inclined surface extending from an upper end of the side wall portion 46*a* toward the downstream in the sheet conveying direction and a following downwardly inclined surface. The protruding support portion 46*b* is formed by continuing a protrusion having a triangular side view in the Y-axis direction (the main scanning direction) includes. The protruding support portion 46*b* is designed to support the sheet P conveyed on the platen 26 from below.

The planar supporting portion 46*c* includes an upwardly gently inclined planar surface extending from the protruding support portion 46*b* toward the downstream in the sheet conveying direction and a substantially horizontal planar surface. The planar supporting portion 46*c* is designed to cover the ink absorbing member 53 from above and to support the sheet P conveyed on the platen 26 from below.

The projections 47 are tongue-like tiny pieces formed so as to extend laterally from both ends of the planar supporting portion 46*c* along the Y-axis direction (main scanning direction). When the projections 47 are engaged with the side frames 48 of the platen main body 26*a*, the platen cover 46 is supported by and fixed to the platen main body 26*a*.

Then, a space to contain the ink absorbing member 53 is formed between the under surface of the platen cover 46 and the upper surface of the placement portion 45. The V-shaped grooves 51 formed in the upper surface of the placement portion 45 extend from the upstream side of the sheet conveying direction, pass under a lower end of the side wall portion 46*a*, and lead to the ink absorbing member 53 downstream of the sheet conveying direction.

The platen cover 46 configured as described above has a function of covering the ink absorbing member 53 as well as a function of supporting the sheet P conveyed on the platen 26 from below by means of the protruding support portion 46*b* and the planar supporting portion 46*c*.

An explanation of functions of the platen 26 and surrounding mechanisms during image recording will now be made with reference to FIG. 6, which is an enlarged cross-sectional view showing the platen 26 and surrounding mechanisms in the recording unit 7.

A margin image recording area G1 is a recordable area when all the nozzles (75 nozzles in the present embodiment) of the recording head 4 aligned along the X-axis direction eject ink. The margin image recording area G1 is defined as an area from a middle portion of the upstream side rib 41 in the sheet conveying direction to the side wall portion of the platen cover 46.

A marginless image recording area G2 is a recordable area when the seventh through twenty-eighth nozzles eject ink. In this case, the nozzles are counted from the most downstream nozzle of the recording head 4 in the sheet conveying direction as the first nozzle toward the upstream direction in the sheet conveying direction. The marginless image recording area G2 is defined as an area from an upstream end of the ink receiving portion 43 in the sheet conveying direction to a top portion 49*a* of the first rib 49 formed on the ink receiving portion 43.

An area between the downstream end of the margin image recording area G1 in the sheet conveying direction and the downstream end of the marginless image recording area G2 in the sheet conveying direction is defined as an extra area G3. The extra area G3 corresponds to a recordable area when the first through sixth nozzles eject ink.

In the margin image recording mode, ink is ejected from the seventy five nozzles corresponding to the margin image recording area G1 toward the sheet P, which is intermittently conveyed in the direction of the arrow A, so that a specified image recording is performed.

In the marginless image recording mode, ink is not ejected toward an area substantially defined by predetermined dimensions (e.g., 3-5 mm) from upper, lower, left and right edges of the sheet P. As a result, the area is left as a margin.

Accordingly, ink ejection in the margin image recording mode is started at a timing as described below. Specifically, ink ejection is started when the front edge of the sheet P, which is conveyed on the platen 26 in the direction of the arrow A, reaches a position where the front edge projects, by a distance corresponding to a dimension of the margin, from the margin image recording area G1 toward the downstream of the sheet conveying direction. In this case, a vicinity of the front edge of the sheet P is supported by the top portion 49*a* of the first rib 49.

When parts of the sheet P, on which image recording has been completed, are conveyed sequentially toward the downstream of the sheet conveying direction, the sheet P having a larger weight due to deposited ink is supported from below by the protruding support portion 46*b* and the planar supporting portion 46*c* formed in the upper portion of the platen cover 46. As a result, a gap between the upper surface of the sheet P and the nozzle surface can be maintained at an appropriate size. Specifically, the gap in the present embodiment is approximately 1.76 mm. If the gap is too large, ink droplets ejected from the nozzles will be scattered in the air, resulting in an inferior image quality. If the gap is too small, the upper surface of the sheet P will slidingly contact the nozzle surface, thereby causing a recording failure.

When the rear edge of the sheet P reaches a position where the rear edge projects, by a distance corresponding to a dimension of the margin, from the margin image recording area G1 toward the upstream of the sheet conveying direction, ink ejection is stopped and the recording is completed.

The sheet P, on which image recording has been completed, is conveyed to a position between the spur roller 28*a* and the sheet discharge roller 28*b* on the downstream side of the sheet conveying direction while being supported by the protruding support portion 46*b*, and is discharged to the sheet discharge portion 10.

If the front end of the sheet P after the image recording rises while being conveyed toward the downstream of the sheet conveying direction, paper jam is likely to be caused before the front end reaches the position between the spur roller 28*a* and the sheet discharge roller 28*b*. The spur roller 56 is designed to prevent the front end of the sheet P from rising.

On the other hand, in the marginless image recording mode, ink is ejected from twenty-two nozzles (the seventh through twenty-eighth nozzles) corresponding to the marginless image recording area G2 to perform image recording without leaving a margin on the edges of the sheet P.

Accordingly, ink ejection in the marginless image recording mode is started at a timing as described below. Specifically, when the front edge of the sheet P, which is fed from the upstream of the sheet conveying direction and conveyed on the platen 26 in the direction of the arrow A while being supported by the upstream side rib 41, enters the marginless image recording area G2, ink ejection is started from the nozzles of the recording head 4 corresponding to the marginless image recording area G2.

The marginless image recording without leaving a margin on the edges of the sheet P is achieved by ejecting ink to an area larger than the recording surface of the sheet P in the marginless image recording area G2. Specifically, ink is ejected also from the nozzles located downstream from the front edge of the sheet P in the sheet conveying direction. Accordingly, extra ink which does not fall on the front edge of the sheet P attaches the first rib 49, the second rib 50 and the V-shaped groove 51 formed on the upper surface of the ink receiving portion 43.

The first rib 49 and the second rib 50 have respective top surfaces located vertically lower than a top surface of the upstream side rib 41 (see FIG. 8B), and the sheet P is supported by the upstream side rib 41. Accordingly, the reverse surface of the sheet P in the front end portion does not contact the top surfaces of the ribs in the marginless image recording area G2, and the extra ink attaching the first rib 49 and the second rib 50 will not attach the reverse surface of the sheet P.

When the image recording on the sheet P progresses, the rear edge of the sheet P enters the marginless image recording area G2 while the rear portion of the sheet P is supported by the protruding support portion 46*b* of the platen cover 46. Then, marginless image recording is performed on the rear edge while the rear edge is supported by the top portion 49*a* of the first rib 49.

Also in this case, the image recording without leaving a margin on the rear edge of the sheet P is achieved by ejecting ink to an area larger than the recording surface of the sheet P in the marginless image recording area G2. Specifically, ink is ejected also from the nozzles located upstream from the rear edge of the sheet P in the sheet conveying direction. Accordingly, extra ink which does not fall on the rear edge of the sheet P attaches the first rib 49, the second rib 50 and the V-shaped groove 51 formed on the upper surface of the ink receiving portion 43.

The extra ink falling on the ink receiving portion 43 follows inclined surfaces of the V-shaped groove 51 and gathers at a bottom of the V-shaped groove 51. Then, the extra ink flows downward in the sheet conveying direction along the V-shaped groove 51 due to the inclination of the ink receiving portion 43 and a capillary phenomenon by wall surfaces of the V-shaped groove 51, and arrives at the placement portion 45. The extra ink is collected by being absorbed by the ink absorbing member 53 placed on the placement portion 45.

According to the configuration as described above, even when a user erroneously uses recording paper with a different width and thereby ink falls on the outside of the recording paper, printing can be continued without soiling the recording paper.

A detailed explanation of the ink absorbing member 53 will now be made with reference to FIG. 10. The ink absorbing member 53 is a flat plate-like member made of a material having a high absorbability, including a porous material such as foamed polyurethane and a fibrous material such as paper and cloth. The ink absorbing member 53, having a width substantially equal to the width of the placement portion 45 of the platen main body 26*a* in the Y-axis direction (the main scanning direction), is placed on the placement portion 45 as shown in FIG. 10A.

The ink absorbing member 53 is supported by the locating projections 54, which are provided slightly downward from an upstream end of placement portion 45 along the X-axis direction (the direction of the arrow A) and the wall surface of the downward end of the placement portion 45 to avoid displacement along the X-axis direction. The ink absorbing member 53 has a height so as not to contact an under surface of the platen cover 46.

Figure 10A:
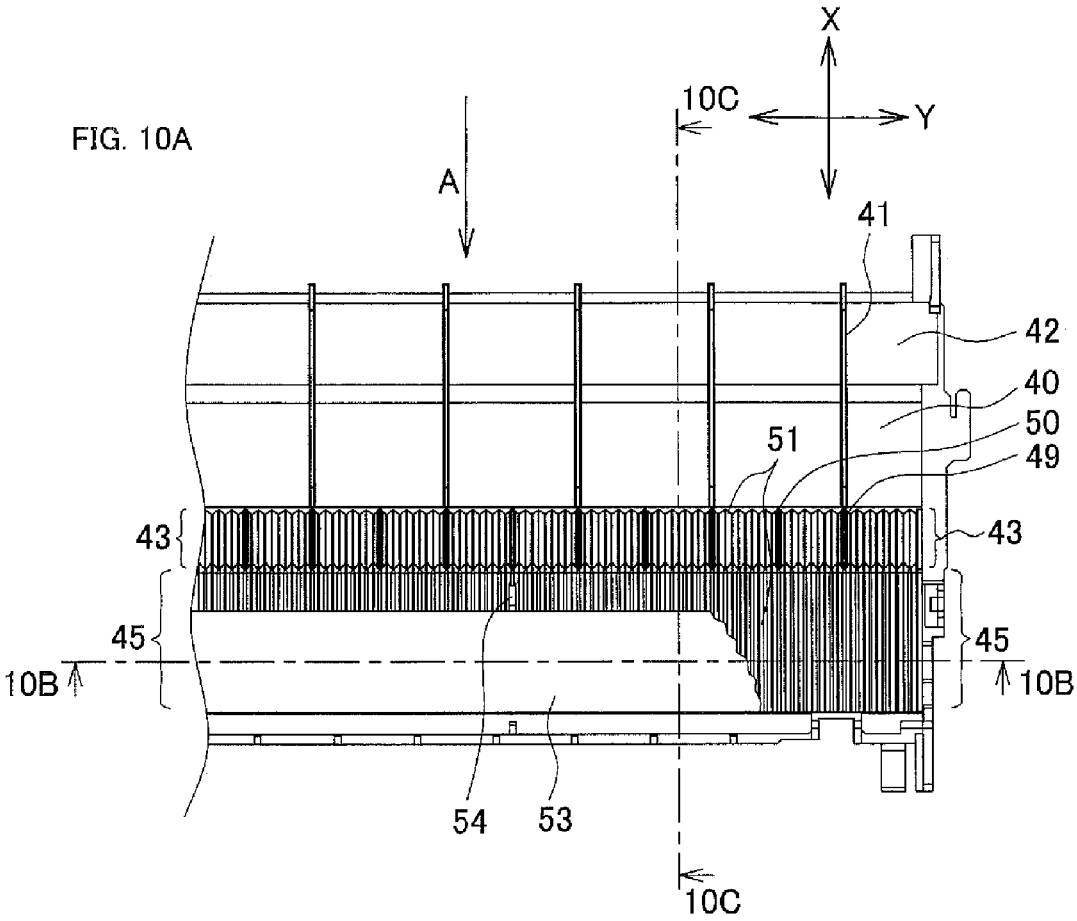
FIGS. 10A, 10B and 10C are a partially enlarged plan view, a cross-sectional view taken in the direction of arrows 10B-10B in FIG. 10A and a cross-sectional view taken in the direction of arrows 10C-10C in FIG. 10A, respectively, showing an arrangement of an ink absorbing member on the platen according to the first embodiment of the present invention.
Figure 10B:
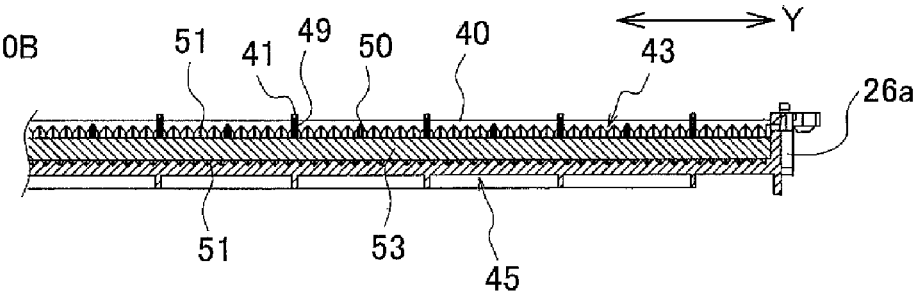
Figure 10C:
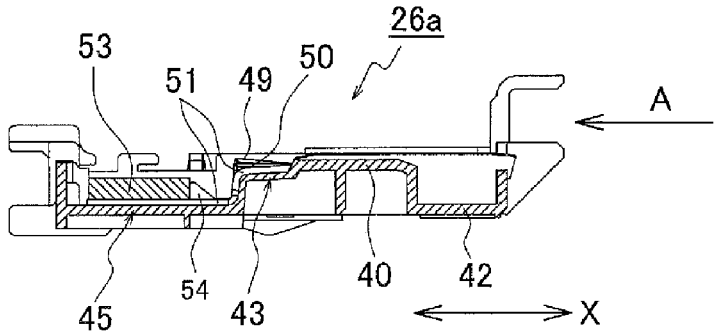

In FIG. 10A, a part (a right end portion in FIG. 10A) of the ink absorbing member 53 is broken away to show the state of the V-shaped grooves 51 formed in the upper surface of the placement portion 45. The ink absorbing member 53, however, is actually placed over to the right end portion of the placement portion 45.

The V-shaped grooves 51 formed in the upper surface of the placement portion 45 extend along an under surface of the ink absorbing member 53 to a downward end of the ink absorbing member 53 in the sheet conveying direction. In other words, the ink absorbing member 53 is placed on the V-shaped grooves 51 arranged abreast of one another (see FIGS. 10B and 10C).

As described above, the extra ink falling on the ink receiving portion 43 follows inclined surfaces of the V-shaped grooves 51 and gathers at the bottoms of the V-shaped grooves 51. Then, the extra ink flows downward in the sheet conveying direction along the V-shaped grooves 51 due to the inclination of the ink receiving portion 43 and a capillary phenomenon by wall surfaces of the V-shaped grooves 51, and arrives at the placement portion 45.

Since the V-shaped grooves 51 extend along the under surface of the ink absorbing member 53 to the downward end of the ink absorbing member 53 in the sheet conveying direction, the extra ink can flow through the V-shaped grooves 51 to all over an area under the ink absorbing member 53. Accordingly, the extra ink is collected by being absorbed through the under surface of the ink absorbing member 53.

Configuration of the Platen 26

Second Embodiment

A configuration of the platen 26 according to a second embodiment will be described hereinafter.

Figure 11A:
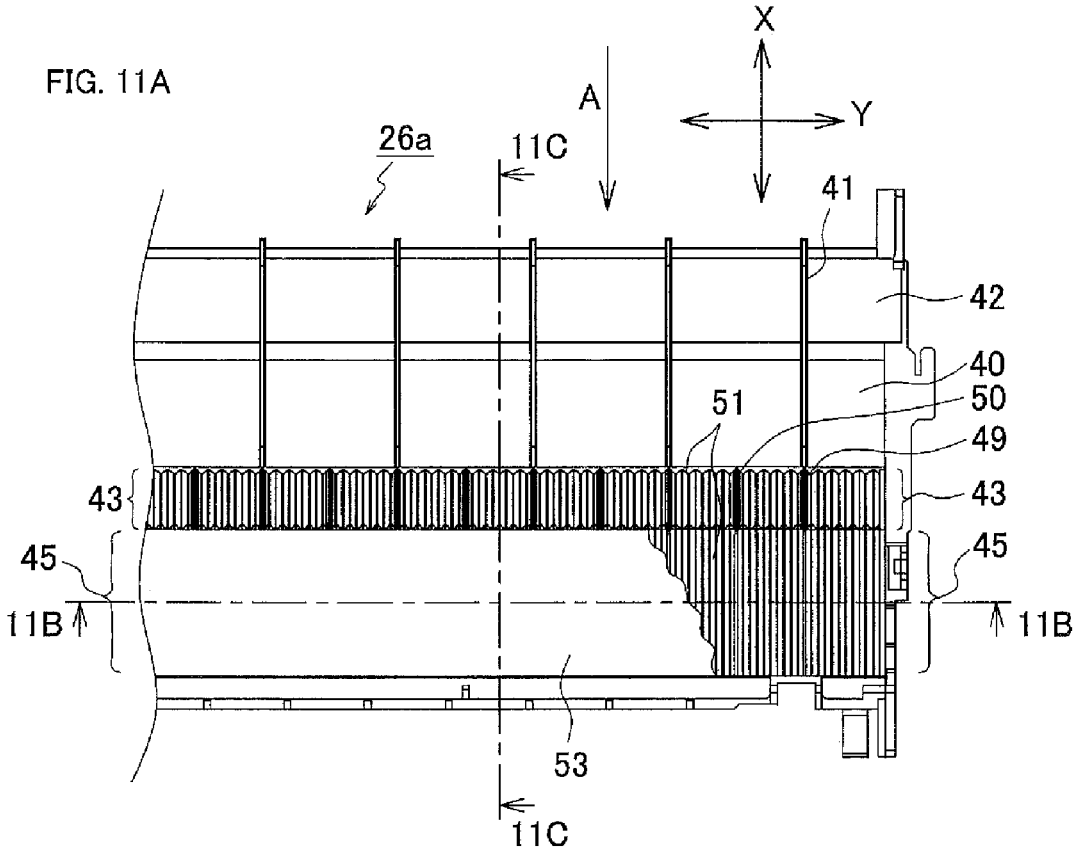
FIGS. 11A, 11B and 11C are a partially enlarged plan view, a cross-sectional view taken in the direction of arrows 11B-11B in FIG. 11A and a cross-sectional view taken in the direction of arrows 11C-11C in FIG. 11A, respectively, showing an arrangement of an ink absorbing member on the platen according to a second embodiment of the present invention.
Figure 11B:
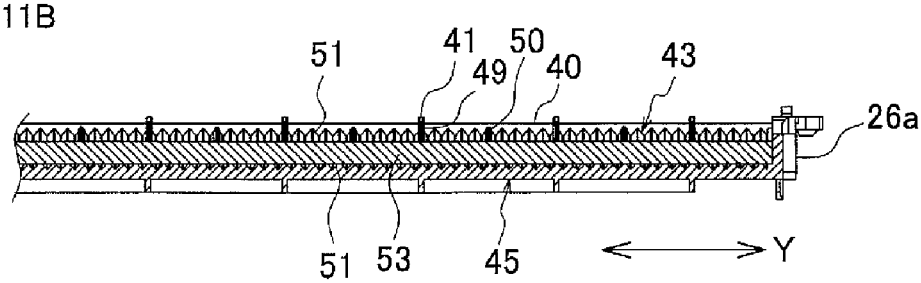
Figure 11C:
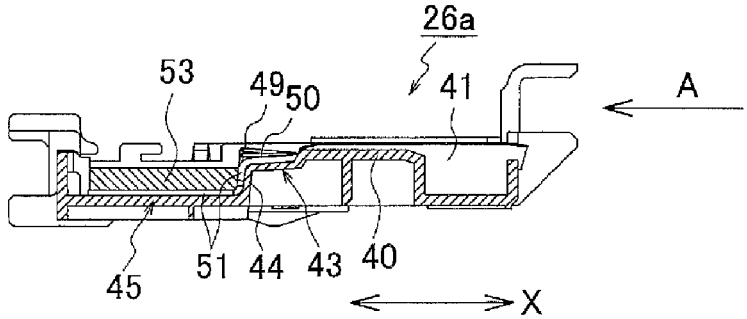

As shown in FIGS. 11A to 11C, the ink absorbing member 53 is placed substantially all over an area on the placement portion 45. A side surface of the ink absorbing member 53 on the upstream side in the sheet conveying direction abuts the wall surface of the downward end of the placement portion 45.

In FIG. 11A, a part (a right end portion in FIG. 11A) of the ink absorbing member 53 is broken away to show the state of the V-shaped grooves 51 formed in the upper surface of the placement portion 45. The ink absorbing member 53, however, is actually placed over to the right end portion of the placement portion 45.

The multiplicity of V-shaped grooves 51 extending abreast of one another from the ink receiving portion 43 further extend through the wall portion 44 to the vicinity of the downward end of the placement portion 45 in the sheet conveying direction (the direction of the arrow A).

In other words, the V-shaped grooves 51 extend along the side surface of the ink absorbing member 53, which abuts the wall portion 44, and an under surface of the ink absorbing member 53 placed on the placement portion 45 to a downward end of the ink absorbing member 53 in the sheet conveying direction (see FIGS. 11B and 11C).

The extra ink falling on the ink receiving portion 43 flows downward in the sheet conveying direction along the V-shaped grooves 51, and is first absorbed, in the wall portion 44, through the side surface and an upper edge portion of the ink absorbing member 53.

Since the V-shaped grooves 51 extend along the under surface of the ink absorbing member 53 to the downward end of the ink absorbing member 53 in the sheet conveying direction, the extra ink not absorbed through the side surface of the ink absorbing member 53 can flow downward in the sheet conveying direction through the V-shaped grooves 51 to an area under the ink absorbing member 53. Accordingly, the extra ink is collected by being absorbed through the under surface of the ink absorbing member 53.

Effects

According to the inkjet recording apparatus 1 of the above described embodiment, the following effects can be achieved.

Figure 12A:
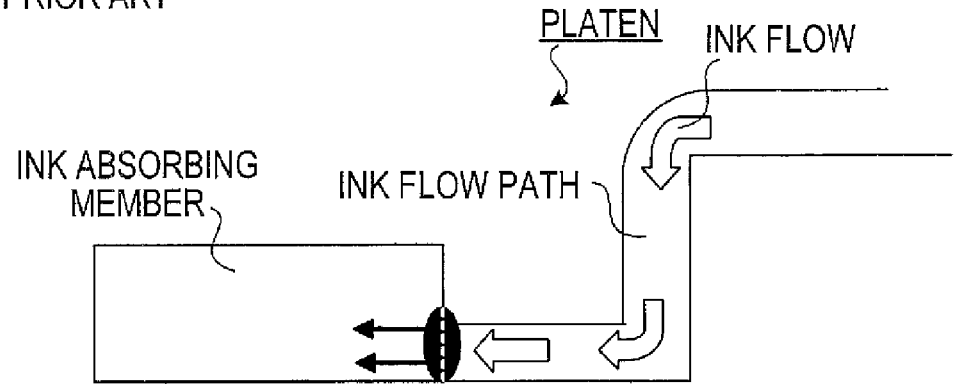
FIG. 12A PRIOR ART
FIG. 12A is a diagrammatic view showing the mechanism of ink absorption by an ink absorbing member according to the prior art.

(1) According to a prior art ink absorbing member as shown in FIG. 12A, ink collectively flows into a limited portion of the ink absorbing member in communication with a path of ink, the ink can be absorbed only through the limited portion of the ink absorbing member.

Figure 12B:
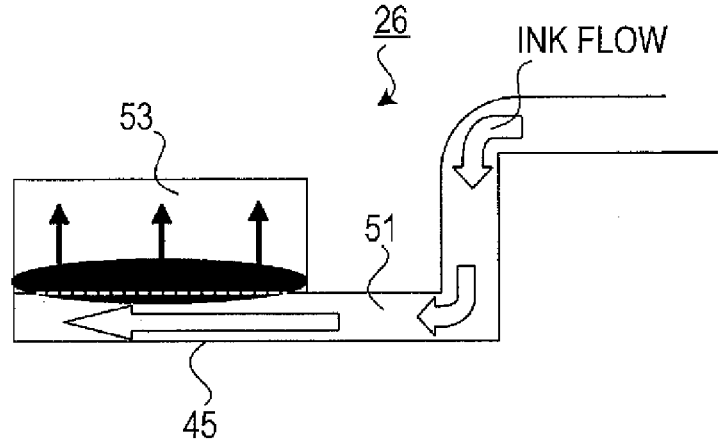
FIGS. 12B and 12C are diagrammatic views showing the mechanism of ink absorption by an ink absorbing member according to the first embodiment and the second embodiment, respectively, of the present invention.

According to the platen 26 in the first embodiment, however, extra ink is absorbed evenly through a large area, in which the V-shaped grooves 51 of the placement portion 45 and the under surface of the ink absorbing member 53 abut each other, as shown in FIG. 12B. Therefore, the extra ink can be immediately absorbed by the ink absorbing member 53 without flowing into a limited portion of the ink absorbing member 53, and the absorbability of the ink absorbing member 53 can be effectively used.

Figure 12C:
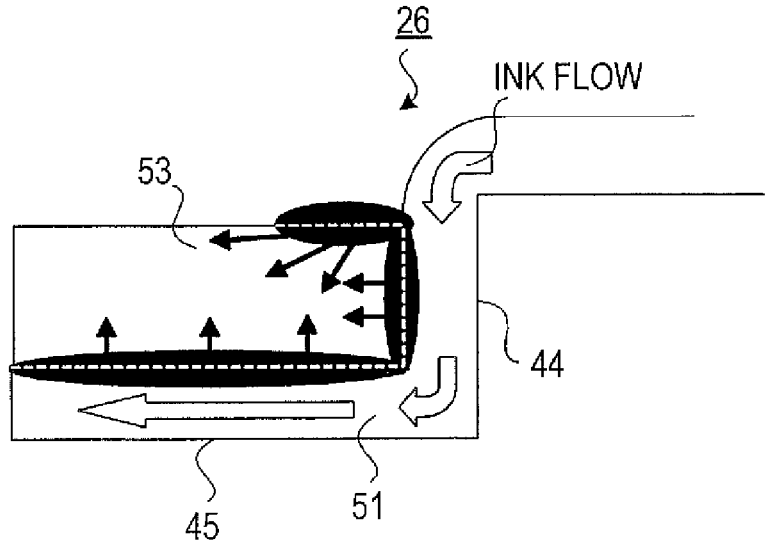

Furthermore, according to platen 26 of the second embodiment, extra ink is absorbed not only through the under surface of the ink absorbing member 53 but also through the side surface abutting the V-shaped grooves 51 formed in the wall portion 44 and the upper edge portion of the ink absorbing member 53. Therefore, the extra ink can be further immediately absorbed through a larger area of the ink absorbing member 53, and the absorbability of the ink absorbing member 53 can be further effectively used, as shown in FIG. 12C.

(2) The V-shaped grooves 51 allow the extra ink to be immediately gathered to the bottoms of the grooves, and the grooves narrowing toward the bottoms effectively cause a capillary phenomenon. Accordingly, the extra ink gathered in the bottoms of the V-shaped grooves 51 can flow immediately. There also is an advantage in that a user, who opens the image scanner 12 in the inkjet recording apparatus 1 to perform some manual operation, is unlikely to touch the extra ink flowing through the V-shaped grooves 51 since the extra ink flows at the bottoms of the narrowing V-shaped grooves 51.

(3) The ink absorbing member 53 for collecting the extra ink is covered with the platen cover 46. Accordingly, a user, who opens the image scanner 12 in the inkjet recording apparatus 1 to perform some manual operation, such as replacing an ink cartridge or removing jammed paper, is unlikely to touch the ink absorbing member 53 soiled with the extra ink. The user, therefore, can keep the hand clean.

Also, it is unnecessary to use a material in which absorbed ink is relatively unnoticeable for the ink absorbing member 53 since the ink absorbing member 53 is not directly seen by the user. Accordingly, a material having a high absorbability can be employed regardless of the color of the material, resulting in an improved performance of the ink absorbing member 53.

Furthermore, since the upper surface of the ink absorbing member 53 is covered with the platen cover 46, the reverse surface of the sheet P will not be soiled by contacting the ink absorbing member 53.

(4) Since the height of the ink absorbing member 53 is limited by the platen cover 46, the reverse surface of the sheet P will not contact the ink absorbing member 53 regardless of the dimensions and the shape of the ink absorbing member 53. Accordingly, it in unnecessary to strictly regulate the dimensions and the shape of the ink absorbing member 53 or waste time for installation of the ink absorbing member 53.

Also, the ink absorbing member 53 may be larger so as to absorb more ink. In this case, the ink absorbing member 53 will allow a longer replacement interval and thus an easier maintenance.

Furthermore, the ink absorbing member 53 placed on the platen 26 does not require a separate case for containing the ink absorbing member 53. Accordingly, reduction of the number of parts and downsizing of an image recording apparatus as a whole can be achieved.

(5) By supporting the sheet P, on which an image has been recorded, by the protruding support portion 46*b* and the planar supporting portion 46*c* formed in the platen cover 46, the gap between the upper surface of the sheet P and the recording head 4 can be maintained in a more stabilized manner. This will lead to an improved quality of a recorded image.

Even when the sheet P is likely to bend due to the humidity or the weight of ink in such a case, for example, where ink is ejected with high density to perform high-image-quality recording, the gap between the upper surface of the sheet P and the recording head 4 can be maintained in a more stabilized manner. This is because the sheet P is supported by a supporting portion, including the protruding support portion 46*b* and the planar supporting portion 46*c*, formed continuously and having a specified height.

(6) Since the placement portion 45 for placing the ink absorbing member 53 is formed integrally with the platen main body 26*a* and is located outside of an area facing the recordable area of the recording head 4, the platen 26 may have a relatively thin configuration. This can reduce an internal space of an inkjet recording apparatus, and thus results in an achievement of the inkjet recording apparatus 1 of a thin type.

Although preferred embodiments of the present invention have been described as above, it is to be understood that the present invention should not be limited to the above described embodiments, but may be embodied in various forms without departing from the spirit and scope of the present invention as set forth in the appended claims.

Figure 13A:
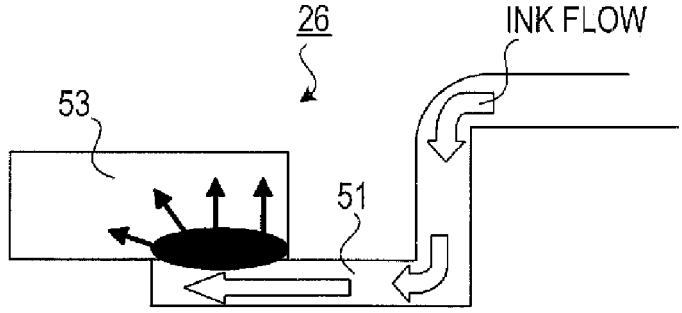
FIGS. 13A to 13D are diagrammatic views showing V-shaped grooves having different lengths under the ink absorbing member according to other embodiments of the present invention.

For example, as shown in FIG. 13A, in an area where the under surface of the ink absorbing member 53 and the upper surface of the placement portion 45 abut each other, the V-shaped grooves 51 may have a length corresponding to half the length of the under surface of the ink absorbing member 53 in the extending direction of the V-shaped grooves 51.

Figure 13B:
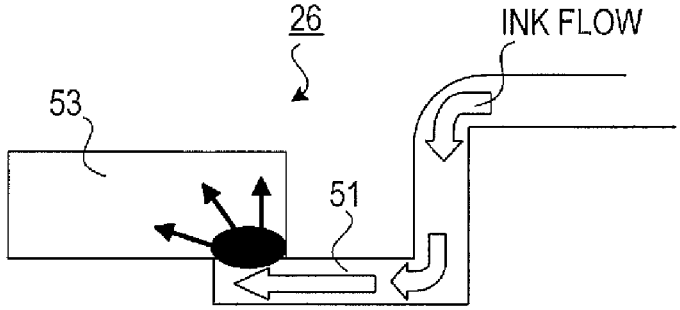

Alternatively, for example, as shown in FIG. 13B, in an area where the under surface of the ink absorbing member 53 and the upper surface of the placement portion 45 abut each other, the V-shaped grooves 51 may have a length corresponding to a part of the length of the under surface of the ink absorbing member 53 in the extending direction of the V-shaped grooves 51.

The length of the V-shaped grooves 51 in an area where the under surface of the ink absorbing member 53 and the upper surface of the placement portion 45 abut each other should not be limited to the above embodiments, i.e., the first and second embodiments, and other embodiments in FIGS. 13A and 13B. That is, any length of the V-shaped grooves 51 in the area may be possible, as long as extra ink can be absorbed through the under surface of the ink absorbing member 53.

Figure 13C:
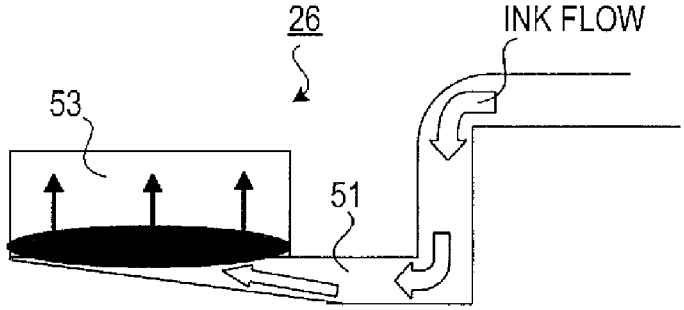

In addition, the V-shaped grooves 51 may be configured to be upwardly inclined toward the downstream in an extra ink guiding direction in an area where the under surface of the ink absorbing member 53 and the upper surface of the placement portion 45 abut each other, as shown in FIG. 13C. In this case, the upward inclination of the V-shaped grooves 51 effectively causes a capillary phenomenon, and thereby the extra ink is guided further downward. Accordingly, the extra ink can be absorbed through a large area of the under surface of the ink absorbing member 53.

Figure 13D:
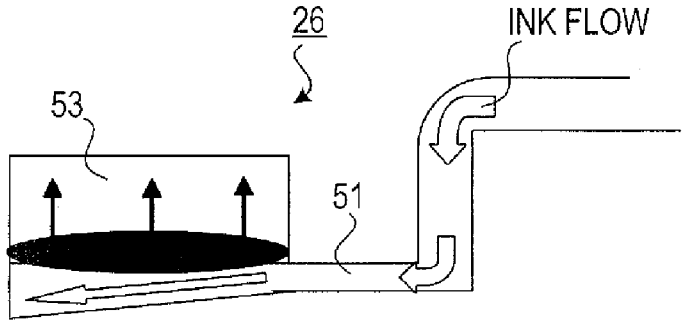

Alternatively, the V-shaped grooves 51 may be configured to be downwardly inclined toward the downstream in an extra ink guiding direction in an area where the under surface of the ink absorbing member 53 and the upper surface of the placement portion 45 abut each other, as shown in FIG. 13D. In this case, the downward inclination of the V-shaped grooves 51 allows the extra ink to be guided further downward. Accordingly, the extra ink can be absorbed through a large area of the under surface of the ink absorbing member 53.

While ink ejected during flushing operation is received by the waste ink receiver 34 in the above embodiments, the ink may be received by the ink receiving portion 43.

Although the present invention has been applied to marginless image recording in the above embodiments, the present invention may be applied to margin image recording as well.

What is claimed is:

1. A platen for supporting a recording medium under a recording head capable of performing image recording with ink droplets on the recording medium, while the recording medium is conveyed along a specified direction in a main body of an inkjet recording apparatus, the platen comprising:

an ink absorbing member that absorbs ink, which is ejected from the recording head;

a platen main body on which the ink absorbing member is placed; and a platen cover that is disposed on the platen main body so as to cover the ink absorbing member from above, the platen main body comprising:

an ink receiving portion that receives ink; and an ink guiding portion that guides the ink received by the ink receiving portion to the ink absorbing member, wherein the platen cover extends, in the specified direction along which the recording medium is conveyed, from a position upstream from the ink absorbing member to a position downstream from the ink absorbing member to cover the ink absorbing member entirely.

2. The platen as set forth in claim 1, wherein the ink guiding portion passes under the platen cover and leads to a position in which the ink absorbing member is disposed.

3. The platen as set forth in claim 1, further comprising a supporting portion provided on an upper surface of the platen cover, wherein the supporting portion is formed continuously so as to have a specified height in a direction perpendicular to a conveying direction of the recording medium.

4. An inkjet recording apparatus comprising the platen as set forth in claim 1.

5. The inkjet recording apparatus as set forth in claim 4, wherein the ink absorbing member is located outside of an area facing the recordable area of the recording head.

6. The platen as set forth in claim 1, the platen main body further comprising:

a placement portion comprising an upper surface on which the ink absorbing member is disposed, the upper surface having formed therein an ink guide groove;

wherein the ink guiding portion guides the ink to the ink guide groove of the upper surface of the placement portion and a bottom portion of the ink guide groove is spaced apart from the ink absorbing member.

7. The platen as set forth in claim 6, wherein the placement portion is formed on an upper surface of the platen.

8. The platen as set forth in claim 7, wherein the ink guiding portion includes a groove, the groove and the ink guide groove constituting a continuous groove.

9. The platen as set forth in claim 8, wherein the ink receiving portion is provided at a position higher than the upper surface of the placement portion.

10. The platen as set forth in claim 8, wherein the platen further includes a wall surface extending from the ink receiving portion to the placement portion, wherein the continuous groove extends from the ink receiving portion to the placement portion through the wall surface, and wherein the ink absorbing member has a side surface abutting the wall surface.

11. The platen as set forth in claim 8, wherein each of the groove and the ink guide groove has a V-shaped configuration.

12. The platen as set forth in claim 8, wherein the continuous groove passes under the platen cover and leads to the ink absorbing member.

13. The platen as set forth in claim 6, wherein the ink guide groove is upwardly inclined toward a downstream in a guiding direction of the ink in an area in which the under surface of the ink absorbing member and the upper surface of the placement portion abut each other.

14. The platen as set forth in claim 6, wherein the ink guide groove is downwardly inclined toward a downstream in a guiding direction of the ink in an area in which the under surface of the ink absorbing member and the upper surface of the placement portion abut each other.

15. The platen as set forth in claim 1, wherein the platen has a substantially flat plate-like configuration.

16. The platen as set forth in claim 1, wherein the ink absorbing member is disposed downstream from the ink receiving portion.

* * * * *